United States Patent [19]

Tyree, Jr.

[11] Patent Number: 4,693,737

[45] Date of Patent: Sep. 15, 1987

[54] REMOTE COOLING $CO_2$ APPLICATIONS

[75] Inventor: Lewis Tyree, Jr., Oak Brook, Ill.

[73] Assignee: Liquid Carbonic Corporation, Chicago, Ill.

[21] Appl. No.: 912,048

[22] Filed: Sep. 25, 1986

[51] Int. Cl.[4] ..... F25J 1/00

[52] U.S. Cl. ..... 62/10; 62/46; 62/384

[58] Field of Search ..... 62/10, 46, 47, 384

[56] References Cited

U.S. PATENT DOCUMENTS

| | | | |
|---|---|---|---|
| 2,496,185 | 1/1950 | Voss et al. | 62/46 |
| 3,660,985 | 5/1972 | Tyree, Jr. | 62/10 |
| 3,754,407 | 8/1973 | Tyree, Jr. | 62/55 |
| 3,810,365 | 5/1974 | Hampton et al. | 62/48 |
| 3,933,001 | 1/1976 | Tyree, Jr. et al. | 62/10 |
| 4,211,085 | 7/1980 | Tyree, Jr. | 62/48 |

OTHER PUBLICATIONS

The HT-300 Satellite $CO_2$ Reservoir "Doing It Nature's Way"—Technical Bulletin by Hafstrom Technical Products, Inc.

*Primary Examiner*—Ronald C. Capossela

*Attorney, Agent, or Firm*—Fitch, Even, Tabin & Flannery

[57] ABSTRACT

A plurality of work stations may be cooled and temperature-controlled with subcooled liquid $CO_2$ without a plurality of mechanical units for cooling $CO_2$ and high capital costs resulting therefrom. The system includes a plurality of spaced-apart enclosures to be cooled, each enclosure having an associated tank containing subcooled liquid $CO_2$ to be directed into the enclosure for cooling it and then to exhaust. The associated tanks are connected to a source of high pressure $CO_2$ such as a large storage vessel which supplies $CO_2$ for the associated tanks and for cooling the associated tanks as by expanding liquid $CO_2$ in the vicinity of the associated tank. After expansion, $CO_2$ vapor is directed to a reservoir or directly back to the storage vessel via a compressor. The reservoir contains $CO_2$ slush and collects vapor $CO_2$ used in the cooling process of a multiplicity of duplicate associated tanks, thus serving as a sink for the collection of $CO_2$ vapor to be ultimately returned to the storage vessel.

14 Claims, 2 Drawing Figures

REMOTE COOLING $CO_2$ APPLICATIONS

Figure 1:
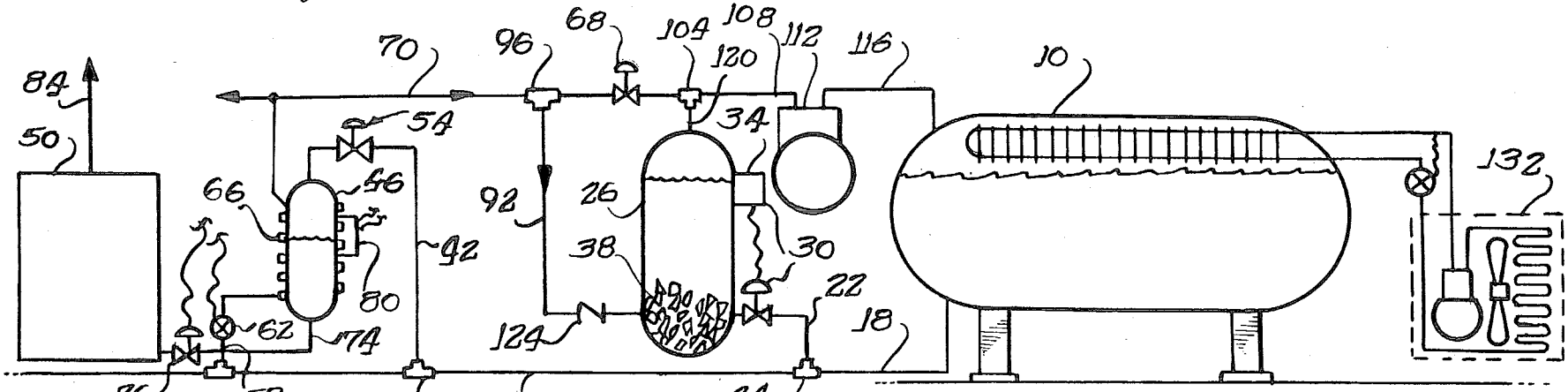

This invention relates generally to the cooling of remote sites by $CO_2$. More particularly this invention relates to a method and system of cooling a plurality of spaced apart enclosures or work cabinets to a temperature of at least about −50° F. or below.

Many work facilities require temperature control work cabinets where components or other items of machinery or devices can be tested at temperatures approximately −50° F. to −100° F. The number of these work control cabinets in a given plant may be quite large, with 25 cabinets spread throughout a large facility not being uncommon. It is difficult and expensive to provide precise control for these cabinets through common thermal compression or mechanical refrigeration units utilizing a recirculating refrigerant, such as a Freon or ammonia. To cool the cabinets with thermal compression units and the like, the required temperature levels for the cabinets are sufficiently low to require complex two-stage systems for the units. Accordingly the use of cryogenics, i.e., expendable $CO_2$ or nitrogen has been widely practiced to provide the cooling. The problem with nitrogen is that the temperature associated with liquid nitrogen (about −300° F.) is not generally required in the cabinet. Moreover, because the liquid nitrogen supply piping from a centralized nitrogen storage vessel generally is extensive, it requires very expensive vacuum-insulated piping to obviate excessive heat leaks to the piping. Similarly, the use of small portable devices involves excessive heat leaks as well as being a less reliable supply system.

A method of cooling temperature-controlled work cabinets with $CO_2$ utilizes so-called "low side floats" so as to maintain a liquid supply of $CO_2$ at each work cabinet. These devices utilize a method of maintaining a pool of liquid, usually a liquified gas, at a given location, wherein the liquid is prone to readily return to the gas phase. The so-called "float" is symbolic of a liquid level control which maintains the level of the liquid pool. It causes liquid to flow to the pool by venting the gas in the pool container to a lower pressure region, the so-called "low side". Two methods can be used to produce the so-called low side pressure: one is venting to atmosphere; the other is raising the liquid supply pressure by a pump so the vapor can be simply returned to the storage vessel.

Another method which uses $CO_2$ to cool a multiplicity of remote temperature controlled work cabinets includes the use of Hafstrom satellite $CO_2$ reservoirs which cool $CO_2$ located at multiple remote locations. In these Hafstrom devices, a large central $CO_2$ storage vessel is provided holding liquid $CO_2$ at a normal storage temperature, 0° F., and pressure, 300 psig. In the event of no or low $CO_2$ use from this vessel, excessive temperature rise and subsequent pressure relief with $CO_2$ venting loss is prevented by the operation of a standard Freon unit. Generally a Hafstrom device is connected to the vapor phase of the storage vessel and thence to other Hafstrom devices. These Hafstrom devices each contain a Freon compressor and a condenser which provide refrigeration sufficient to draw $CO_2$ vapor through a main line from the storage vessel, and then through an individual line to a $CO_2$ container. At the container, the $CO_2$ vapor is condensed to liquid at slightly less than 0° F. by the action of the single stage Freon compressor, the heat so generated being rejected through the condenser. All of these functions are packaged in one unit and placed either above or below a work cabinet which requires the controlled temperature. The work cabinet is connected to the $CO_2$ container by a line so that the liquid $CO_2$ condensed in the container can be drawn from the container in the Hafstrom device and released inside the work cabinet. After providing the refrigeration, the $CO_2$ vapor warms and is discharged from the work cabinet to the atmosphere, usually outside the work area. These devices, however, do not provide a centralized equipment system. This results in higher equipment costs. Moreover, the Hafstrom devices use relatively large amounts of energy to provide relatively cold $CO_2$, such as at about −70° F., to a work cabinet.

It is an object of this invention to provide a method and system using $CO_2$ to cool to one or more work stations.

It is another object of the invention to provide a method and system using $CO_2$ to cool a plurality of spaced-apart work stations through a centralized equipment system with reduced capital costs.

It is yet another object of the invention to provide subcooled liquid $CO_2$ to cool a plurality of spaced-apart work stations, utilizing less $CO_2$ for a given cooling capacity to provide an efficient $CO_2$ cooling method and system.

In addition, the invention allows programming of its use so that its principal electric demand can be scheduled at OFF-PEAK times without having to suffer substantial penalties in either equipment or operating costs.

Figure 2:
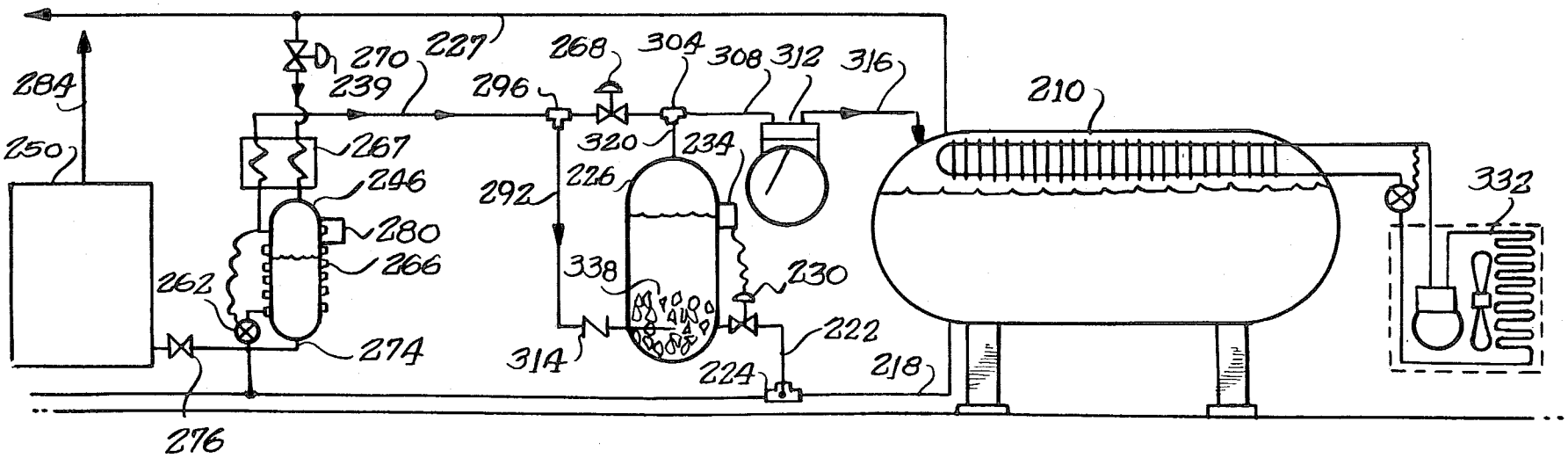

These and other objects of the invention should be apparent from the following detailed description for carrying out the invention when read in conjunction with the accompanying drawings wherein:

FIG. 1 is a diagrammatic view showing a temperature-controlled work cabinet in conjunction with a system for providing $CO_2$ for cooling the cabinet according to the invention by subcooling liquid $CO_2$; and FIG. 2 is a diagrammatic view of an alternative embodiment of the invention showing a temperature-controlled work cabinet in conjunction with a system for providing $CO_2$ for cooling the cabinet according to the invention by condensing $CO_2$ vapor and cooling the condensed $CO_2$.

Briefly, it has found that a plurality of work stations may be temperature-controlled with subcooled $CO_2$ without a plurality of mechanical units for cooling $CO_2$ and high capital equipment and energy costs resulting therefrom. The method and system according to the invention are more efficient than known methods and systems because the $CO_2$ supplied to the work stations is colder, and accordingly less $CO_2$ is expended when achieving a given cooling capacity.

The method and system of the invention includes a storage vessel which is a large source of high pressure $CO_2$ and a plurality of duplicate spaced-apart enclosures to be cooled by liquid $CO_2$. Usually such a source is maintained at a normal temperature of about 0° F. and a pressure of about 300 psig by a mechanical refrigeration unit. Each of the spaced-apart enclosures has an insulated associated tank which is a source of subcooled liquid $CO_2$ at a pressure between about 100 and about 150 psig for cooling and temperature control of the enclosures. Each associated tank has a $CO_2$ inlet and vapor outlet and is cooled by heat exchange with cold $CO_2$ vapor. Such subcooling may be achieved by expanding $CO_2$ vapor in the vicinity of the associated tank. For example, $CO_2$ may be expanded through a coil within or surrounding the tank to cool it.

A reservoir containing $CO_2$ at about its triple point is connected to both the inlets and outlets of the plurality of duplicate associated tanks and to the storage vessel. In FIGS. 1 & 2, the storage vessel via a first conduit provides each of the associated tanks, the reservoir and the $CO_2$ expansion coils for cooling the associated tank with high pressure $CO_2$ having a temperature in the range of about +5 to about −5° F. A second conduit for the flow of vapor $CO_2$ connects the associated tank with the reservoir and storage vessel for the return of $CO_2$ vapor either directly to the storage vessel via a compressor or to the reservoir which condenses the $CO_2$ vapor upon contact with solid $CO_2$ in the reservoir. Hence, the reservoir serves as a sink for the collection of $CO_2$ vapor which will preclude overloading the compressor with $CO_2$ vapor returning to the storage vessel. It also permits economical operation of the compressor at night or at times when power rates are low. At such times, the compressor draws $CO_2$ vapor from the reservoir causing liquid $CO_2$ therein to evaporate and replenish solid $CO_2$ which was melted in the reservoir during peak operating hours of the system; the withdrawn $CO_2$ vapor is transferred to the storage vessel.

A third conduit connects the enclosure with an associated tank. The third conduit provides a flow of subcooled high pressure liquid $CO_2$ having a temperature of about −50° F. or below from the associated tank to cool and maintain a desired temperature within the enclosure.

A fourth conduit may be provided to connect the vapor space of the storage vessel with each of the associated tanks in a manner to be hereinafter described.

$CO_2$ may be supplied to the associated tank from the supply vessel either as a liquid, or alternatively, as a vapor as explained in detail hereinafter.

Depicted in FIG. 1 is a system to practice the method of the invention to provide a plurality of space-apart enclosures or work places with a temperature of about −50° F. or below. The system includes a main storage vessel 10 containing liquid $CO_2$. The temperature and pressure of the $CO_2$ in the storage vessel is 10° F. or lower and is preferably in the range from about −5° F. to about +5° F. and from about 270 to about 315 psig, respectively. Generally, however, the $CO_2$ in the storage vessel is about 0° F. and has a pressure of about 300 psig. Line 18 from a lower portion of the storage vessel 10, below the level of liquid $CO_2$ therein, connects to line 22 through tee 24 to provide a flow of liquid $CO_2$ from the storage vessel to a reservoir 26 through a valve 30 which is controlled by control panel 34. The reservoir 26 for a standard installation may have a volume in the range of about 10 to about 50 cubic feet and thus be capable of holding from about 750 to about 3,750 pounds of $CO_2$ at its triple point (about −70° F. and about 60 psig). Line 18 also connects to a series of insulated associated tanks 46, one of which is illustrated and is connected through tee 44 and line 42. Each associated tank is associated with a work cabinet 50 to provide the cabinet with a supply of cold liquid $CO_2$.

The associated tank contains high pressure liquid $CO_2$. Liquid $CO_2$ flows to the associated tank from the storage vessel 10, via line 18 and line 42 which contains valve 54 and leads to the upper portion of the associated tank 46. The pressure in the associated tank will be about the pressure in the storage vessel.

Line 18 extends past tee 44 to branch line 58 to provide for a flow of high pressure liquid $CO_2$ to an expansion valve 62 and expansion coil 66. The coil surrounds associated tank 46, and when high pressure liquid $CO_2$ is supplied to the expansion valve, the liquid $CO_2$ expands to cold vapor at about −60° F. and flows through the coil to cool the tank. After the $CO_2$ expands in the expansion coil 66, the expanded $CO_2$ vapor is returned to the storage vessel through a $CO_2$ vapor return line 70. A pressure regulator 68 in the vapor return line 70 controls the pressure in the coil and at the expansion valve, being set so that pressure of the $CO_2$ in the coil does not go below 65 psig, and preferably not below about 75 psig, so $CO_2$ snow does not form in the coil or in any line downstream from the coil.

The associated tank 46 supplies cold, high pressure $CO_2$ having a temperature of about −50° F. or below to the work station 50 for the refrigeration and temperature control thereof. Line 74 provides a conduit for the cold liquid $CO_2$ from the lower portion of the associated tank to flow to the work cabinet through valve 76. Valve 54, expansion valve 62 and valve 76 all are controlled by control panel 80. After being released inside the work cabinet and providing refrigeration and temperature control therefor, the relatively warm $CO_2$ vapor is discharged from the work cabinet from exhaust 84 and suitably vented from the building.

Vapor return line 70 connects through tee 96 branch line 92 which leads to reservoir 26 to provide a normal path for the flow of $CO_2$ vapor from line 70 through check valve 124 into the lower portion of reservoir 26. Thus, $CO_2$ vapor carried by the line 92 enters the lower portion of the reservoir where it contacts the $CO_2$ slush therein and condenses, melting solid $CO_2$ in the process. Vapor line 120 at the upper portion of the reservoir 26 provides a conduit for vapor $CO_2$ from the reservoir through tee 104, and thence to line 108 and an inlet of a compressor 112 which compresses and returns the vapor to the storage vessel via line 116. Control panel 34 also controls compressor 112. $CO_2$ vapor from line 70 which does not enter the reservoir flows through the pressure regulator valve 68 to tee 104 and thence to line 108 leading to the inlet of the compressor 112 to be compressed and returned as $CO_2$ vapor to upper portion of the storage vessel through line 116.

The storage vessel has a refrigeration unit 132 which operates to try to maintain the desired pressure and temperature in the storage vessel; during off-peak or night time hours it functions indirectly to create $CO_2$ slush in reservoir 26. As a result the refrigeration unit or multiple units should be somewhat oversized with respect to the standard unit that would be supplied with a $CO_2$ storage vessel of a given size, preferably having a capacity of about 50,000 BTU/hr for a storage vessel that is designed to hold about 30 tons of $CO_2$, but the size is more a function of compressor 112 and its duty cycle. Solid or slush $CO_2$ 38 is created in reservoir 26 by first admitting liquid $CO_2$ from the storage vessel into the reservoir via lines 18 and 22. Thereafter, vapor is removed by compressor 112 and returned to the storage vessel via line 116 causing continuing evaporation of some liquid $CO_2$ and freezing or solidification of the $CO_2$ at the surface. Once the reservoir 26 contains at least about 750 pounds of slush for a system having a size of 10 $ft^3$, the system is considered to be in full operating condition, and the compressor 34 can be shut down.

Liquid $CO_2$ is supplied to the associated tank 46 through lines 18 and 42 and through valve 54 which controls the flow of liquid $CO_2$ therethrough. At the same or different times liquid $CO_2$ is being directed into the associated tank, high pressure liquid $CO_2$ is supplied through line 18 to line 58 and thence to expansion valve 62. At the expansion valve, the high pressure liquid $CO_2$ is expanded through coil 66 to a low pressure and temperature, as aforesaid, to cool the associated tank and $CO_2$ liquid 52 therein to at least about −50° F. or below. When the work chamber 50 requires cooling, the control panel 80 allows the subcooled $CO_2$ liquid to flow from the associated tank through line 74 and valve 76 to the work cabinet for cooling. After providing its cooling effect, the $CO_2$ exits through exhaust 84 and is vented from the building.

The $CO_2$, which has been expanded in coil 66 for cooling the associated tank, flows through the vapor return line 70 either to line 92 or through pressure regulator valve 68. Generally the vapor returning through line 70 will be directed to reservoir 26 through line 92 and check valve 124. Check valve 124 controls the flow of vapor into the reservoir and will close if the pressure in line 92 falls about 10 psi below the triple-point pressure in the reservoir. The reservoir is connected with the storage vessel via lines 120, 108 and compressor 112. As $CO_2$ vapor enters reservoir 26, the vapor contacts slush 38 and condenses to liquid. In the event that the use of the reservoir becomes heavy so that all or substantially all of the slush therein is gone and pressure in the reservoir has risen, the valve 124 closes so the vapor in line 70 by-passes the reservoir and proceeds through the pressure regulator 68 to the compressor 112 and storage vessel. As the slush chamber becomes nearly full and the check valve 124 closes, vapor is pulled from the reservoir by the compressor and delivered to the storage vessel 10. Hence, the reservoir is used as a sink to condense $CO_2$ vapor during a work day when power costs are high; at night when power costs are less expensive, $CO_2$ vapor is drawn from the reservoir and delivered to the storage vessel where it is condensed using the vessel's refrigeration system 132.

FIG. 2 depicts an alternative embodiment of the invention wherein $CO_2$ is supplied to the associated tank as vapor from the storage vessel and condensed in the associated tank as opposed to being supplied as liquid to the associated tank from the storage vessel.

In the alternative embodiment, the system includes a storage vessel 210 containing liquid $CO_2$. Line 218 from the lower portion of the storage vessel 210 and below the level of liquid $CO_2$ therein connects to line 222 through tee 224 to provide a conduit and flow of liquid $CO_2$ from the storage vessel to reservoir 226 through valve 230 which is controlled by control panel 234. Vapor supply line 227 connects the upper portion of the storage vessel with upper portion of an associated tank 246 to provide a conduit for the flow of vapor $CO_2$ from the storage vessel 210 to supply the associated tank 246 with $CO_2$ vapor through valve 239 which controls the flow of vapor to the associated tank. The supply of $CO_2$ vapor to the associated tank in vapor form is advantageous because many, if not most, of the impurities in the $CO_2$ liquid in the storage vessel are left in the storage vessel and are not transferred with the vapor $CO_2$ flowing to the associated tank. When the vapor $CO_2$ from the storage vessel reaches the associated tank 246 which is being cooled by a coil 266 similar to the coil 66 described hereinbefore, the vapor $CO_2$ which is relatively free of impurities condenses and is cooled for eventual use in work cabinet or station 250. Impurities left in the storage vessel may be periodically removed, as by draining and/or skimming.

Liquid $CO_2$ line 218 provides a conduit for a flow of high pressure $CO_2$ liquid to expansion valve 262 and the expansion coil 266 which coil surrounds associated tank 246 to cool it as described in respect to the first embodiment of the invention. The expansion coil 266 exhausts to vapor return line 270 through an optional heat exchanger 267 wherein the cold vapor precools the approximately 0° F. vapor flowing into the tank 246 from the storage vessel 210.

As with the embodiment of FIG. 1, the associated tank 246 supplies cold $CO_2$ having a temperature of at least about −50° F. or below to the work station 250 for the refrigeration and temperature control thereof. Line 274 provides a conduit for the cold $CO_2$ liquid from the lower portion of the associated tank to the work cabinet through valve 276. Valve 239, expansion valve 262 and valve 276 all are controlled by control panel 280. After being released inside the work cabinet and providing refrigeration and temperature control therefor as is known, the $CO_2$ is warmed, vaporized and discharged from the work cabinet from exhaust 284.

After the expansion in the coil, the $CO_2$ vapor is returned to reservoir 226 and storage vessel 210 generally as described in the first embodiment of the invention, but passing first through the optional heat exchanger 267.

Vapor return line 270 connects to vapor line 292 through tee 296. Branch line 292 connects vapor line 270 with reservoir 226 to provide a normal path for the flow of $CO_2$ vapor from line 270 through check valve 314 into the lower portion of reservoir 226. Thus $CO_2$ vapor carried by line 292 enters the lower portion of the reservoir where it contacts the solid or $CO_2$ slush 338 therein and condenses to liquid. Vapor line 320 at the upper portion of the reservoir 226 provides a conduit for vapor $CO_2$ from the reservoir to tee 304, and line 308 to an inlet of a compressor 312 for the return of $CO_2$ vapor from the reservoir to the storage vessel line 316. Control panel 234 controls compressor 312. $CO_2$ vapor can also flow directly from line 270 through pressure regulator 268 to tee 304 and thence to line 308 and the compressor 312 which compresses the vapor and returns it to upper portion of the storage vessel through line 316.

The storage vessel has a refrigeration unit 332 which provides additional refrigeration upon demand to cool the storage vessel or to provide cooling needed to create the initial or supply of $CO_2$ slush or solid in reservoir 226 as described in the first embodiment of the invention.

As with the first embodiment of the invention, reservoir 226 may be used as a sink to accumulate $CO_2$ vapor during a work day when power costs are high. At night when power costs are less expensive, $CO_2$ may be drawn from the reservoir and delivered to the storage vessel for reuse. In practise, an installation may include a plurality of work cabinets, some of which are cooled by $CO_2$ from associated tanks 46 connected to the storage vessel as described with respect to FIG. 1 and some may be cooled by $CO_2$ from associated tanks 246 as per FIG. 2.

It should be understood that while certain preferred embodiments of the present invention have been illustrated and described, various modifications thereof will become apparent to those skilled in the art, and accordingly, the scope of the present invention should be defined only by the appended claims and equivalent thereof.

What is claimed is:

1. A method for providing a plurality of spaced-apart enclosures having a temperature of about −50° F. or below, which method comprises providing a plurality of spaced-apart enclosures to be refrigerated, providing a source of high pressure $CO_2$ at a temperature of about 10° F. or lower, flowing $CO_2$ from said high pressure source to a plurality of tanks one of which is associated with each of said enclosures to provide high pressure liquid $CO_2$ therein, creating a separate reservoir of $CO_2$ slush at the triple point thereof, providing cold $CO_2$ vapor for absorbing heat from each of said tanks to subcool high pressure $CO_2$ therein and warm said vapor, causing said warmed $CO_2$ vapor to flow into said $CO_2$ slush reservoir and condense to liquid by melting a solid portion of said slush, and supplying subcooled liquid $CO_2$ to each of said enclosures from said associated tank to maintain a desired temperature within said enclosure.

2. A method in accordance with claim 1 wherein vapor is withdrawn from said $CO_2$ slush reservoir, compressed and returned to said source of high pressure $CO_2$.

3. A method in accordance with claim 1 wherein said subcooled $CO_2$ is vaporized to cool said enclosures to the desired temperature and said resultant vapor is vented to the atmosphere.

4. A method in accordance with claim 1 wherein high pressure liquid $CO_2$ from said source is caused to flow into said tanks and is subcooled to at least about −50° F. by heat exchange with low pressure $CO_2$ vapor.

5. A method in accordance with claim 4 wherein said $CO_2$ vapor being used for said heat exchange is at a pressure in the range of from about 75 psig to about 90 psig.

6. A method in accordance with claim 1 wherein high pressure $CO_2$ vapor from said source is caused to flow into said tanks and is condensed and subcooled therein to at least about −50° F. by heat exchange with cold low pressure $CO_2$ vapor.

7. A method in accordance with claim 6 wherein said cold low pressure $CO_2$ vapor is at a pressure of about 90 psig or below.

8. A method in accordance with claim 6 wherein said cold low pressure $CO_2$ vapor is provided by expanding high pressure liquid $CO_2$ in the vicinity of said tank.

9. A method in accordance with claim 6 wherein said cold low pressure $CO_2$ vapor is provided by expanding and lowering the pressure of high pressure $CO_2$ vapor in the vicinity of said tank.

10. A system for providing a plurality of spaced-apart enclosures with liquid $CO_2$ having a temperature of −50° F. or below, the system comprising a plurality of spaced-apart enclosures to be refrigerated;

means for maintaining a supply of high pressure $CO_2$ at a temperature of about 10° F. or below;

means for maintaining a reservoir of $CO_2$ slush at the triple point thereof;

a plurality of associated tanks, each one of which is associated with an enclosure to provide high pressure liquid $CO_2$ therein;

means for providing cold $CO_2$ vapor for absorbing heat from each of the tanks to subcool liquid $CO_2$ therein;

first conduit means for the flow of liquid $CO_2$ therethrough connected to said supply of high pressure $CO_2$, to the reservoir means, to each one of the tanks and to the means for providing cold $CO_2$ vapor;

second conduit means for the flow of vapor $CO_2$ therethrough connected to each one of the tanks to the supply means and to the reservoir means wherein condensation of $CO_2$ vapor occurs upon contact with the $CO_2$ slush therein; and a plurality of third conduit means which connect an enclosure with an associated tank associated with the enclosure for the flow of subcooled liquid $CO_2$ to each of the enclosures from the associated tanks to cool and maintain a desired temperature within the enclosure.

11. A system in accordance with claim 10 wherein said supply means is a storage vessel holding liquid $CO_2$, wherein the reservoir means is designed to hold $CO_2$ slush at the triple point and wherein the system further includes a compressor to compress vapor from said $CO_2$ slush reservoir and return it to said storage vessel.

12. A system in accordance with claim 11 wherein the system includes expansion coils for the expansion of high pressure liquid $CO_2$ from said first conduit means to create cold low pressure $CO_2$ vapor in the vicinity of the associated tanks.

13. A system in accordance with claim 10 wherein said second conduit means provides for a flow of high pressure $CO_2$ vapor from said supply means to the associated tanks where the vapor is condensed and subcooled therein to at least about −50° F. by heat exchange with cold low pressure $CO_2$ vapor.

14. A system in accordance with claim 10 wherein the system includes expansion coils for the expansion of high pressure liquid $CO_2$ from said first conduit means to create cold low pressure $CO_2$ vapor in the vicinity of the associated tanks.

* * * * *